United States Patent [19]

Arthur et al.

[11] 4,421,055

[45] Dec. 20, 1983

[54] APPARATUS FOR TREATING FILTER MATERIAL

[75] Inventors: Hugh M. Arthur, High Wycombe, England; Françis A. M. Labbe, Neuilly-sur-Seine, France

[73] Assignee: Molins Limited, London, England

[21] Appl. No.: 169,358

[22] Filed: Jul. 16, 1980

[30] Foreign Application Priority Data

Jul. 17, 1979 [GB] United Kingdom ..... 7924869

[51] Int. Cl.[3] ..... B05C 5/00; B05C 15/00

[52] U.S. Cl. ..... 118/620; 118/62; 118/325; 118/326; 118/603; 118/DIG. 16

[58] Field of Search ..... 118/325, 326, DIG. 16, 118/603, 610, 62, 620, 50; 68/205 R

[56] References Cited

U.S. PATENT DOCUMENTS

| | | | |
|---|---|---|---|
| 349,463 | 9/1986 | Sparks | 427/424 X |
| 1,529,134 | 3/1925 | Kelter | 118/325 |
| 3,418,969 | 12/1968 | Harris | 118/325 |
| 3,424,125 | 1/1969 | Wiggins | 118/326 X |
| 3,529,573 | 9/1970 | Baeni et al. | 118/308 |
| 3,572,061 | 3/1971 | Hering, Jr. | 118/325 X |
| 3,594,228 | 7/1971 | Mock | 118/325 X |
| 3,741,846 | 6/1973 | Greve | 118/325 X |
| 3,958,532 | 5/1976 | Timson | 118/62 |
| 4,086,872 | 5/1978 | Pan | 427/27 |
| 4,132,189 | 1/1979 | Greve et al. | 118/325 X |
| 4,313,974 | 2/1982 | Greve et al. | 427/424 X |

*Primary Examiner*—John P. McIntosh

*Attorney, Agent, or Firm*—Antonelli, Terry & Wands

[57] ABSTRACT

Apparatus for treating filter material, particularly a filter tow for forming into a cigarette filter rod, includes an applicator chamber containing a rotatable brush for spraying a fluid additive such as a plasticizer towards the tow. A pressure manifold having a permeable surface adjacent the path of the tow produces an air flow which redirects towards the tow of plasticizer not captured initially by the tow. Air supplied to the manifold passes through an air ionization region, to reduce static electricity in the chamber. Air is withdrawn from the chamber by a pump to prevent a pressure build-up which could cause loss of uncaptured plasticizer. A separator is provided for collecting any plasticizer entrained with the extracted air and for returning it to a supply tank.

27 Claims, 4 Drawing Figures

Figure 1:
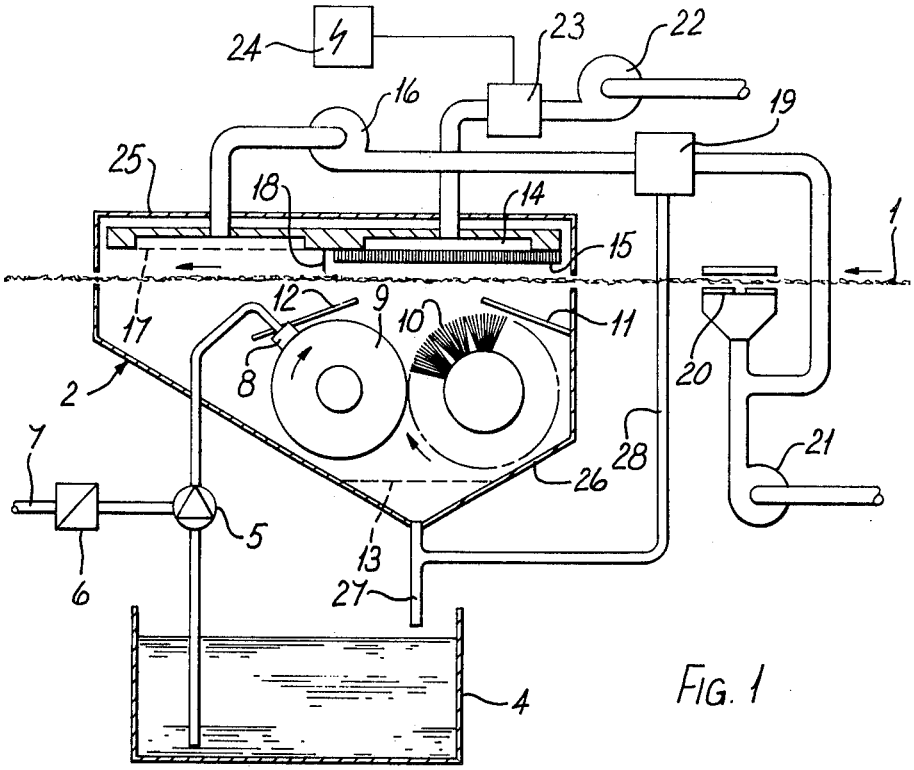

FIG. 3
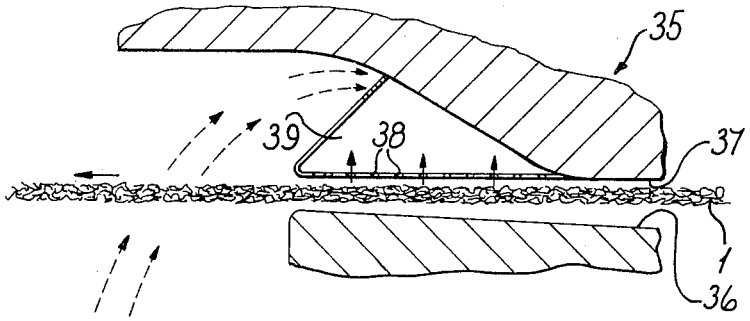
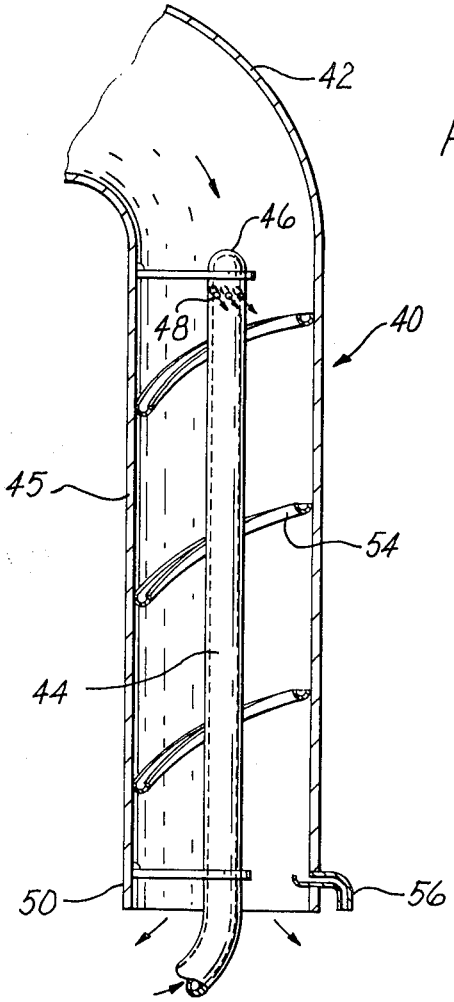
FIG. 4

APPARATUS FOR TREATING FILTER MATERIAL

This invention relates to apparatus for treating filter material, particularly in the production of filter rod for the tobacco industry.

Filter rods for making filters for attachment to cigarette lengths, may be made by continuously forming a tow of filter material, e.g. cellulose acetate, into a rod in a rod making machine, e.g. Molins PM5N. Conventionally a so-called plasticiser (commonly glyceryl triacetate) is added to the tow before it is passed into the rod-forming device. When cured, the plasticiser improves the properties of the finished rod by hardening it. It is desirable that the device which applies the plasticiser should distribute the plasticiser as evenly as possible throughout the tow.

The present invention is concerned with apparatus which includes means for applying a fluid additive such as a plasticiser to a tow of filter material.

According to a first aspect of the present invention apparatus for treating filter material includes means defining a path for filter tow, means for supplying fluid additive, and means for causing an air flow to direct additive towards the tow on said path. The supplying means may be arranged to direct additive towards the air flow means and may include means for spraying additive towards the tow. The air flow means may be arranged to direct (or redirect) additive which has passed through the tow back towards the tow. The supply means and the air flow means are preferably arranged on opposite sides of the tow path. The air flow means may be arranged to direct additive over a substantial area of the tow path, e.g. over substantially the entire width of the tow path.

In a preferred arrangement the air flow means comprises a permeable element positioned alongside the tow path, and forming a boundary of an air pressure manifold. The element may comprise a plate which has a microporous structure wherein the mean pore size and pitch is small in relation to the size of incident droplets of additive. The pressure differential across the plate may be maintained such that the air velocity through the plate is relatively high.

The apparatus may include a chamber through which the path of the tow passes and in which fluid additive is applied to the tow. Means for controlling air pressure in the chamber, preferably arranged to maintain air pressure in the chamber at slightly below ambient pressure, may be provided, including means for extracting air from the chamber.

Ionised air may be supplied to the region in which fluid additive is applied to the tow. Ionised air is useful for removing electrostatic charges which may build up on the tow. The ionised air may be produced by moving the air past a high voltage alternating source. Preferably the ionised air is supplied to and by the air flow means, preferably in a chamber.

According to a second aspect of the invention apparatus for treating filter material comprises an applicator chamber through which filter tow may be passed, having applicator means by which fluid additive is supplied to the tow, including means for extracting air from the chamber. By extracting air the pressure in the chamber may be maintained or depressed and so prevent a pressure build-up which would tend to cause escape of uncaptured additive with the outgoing tow. A pressure build-up is especially likely if air is being supplied to the booth, e.g. as in the arrangement according to the first aspect of the invention.

Preferably the means for extracting air is positioned so that air is drawn through the tow before extraction. Preferably the extraction means is downstream of the applicator means relative to the tow path. Conveniently the air extraction means may be on the opposite side of the path of the tow to the applicator means so that additive entrained with the air may be captured by the tow before extraction. Where air is supplied to the booth according to the first aspect of the invention the air extraction means may be spaced from the air supply means by a baffle or the like so that supplied air (and subsequently entrained additive) has to pass twice through the tow before extraction; this further improves capture of additive by the tow.

Air extracted from a chamber in which additive is applied is preferably passed through a separator to extract additive entrained with the air. The separator may be associated with an air outlet and may be in the chamber so that extracted additive drains in the chamber to supplement additive being supplied to it. Alternatively, where the separator is external to the chamber the extracted additive may be returned to a supply tank or to the chamber via a conduit. The extracted air may pass from the separator to a conventional banding jet for the tow; this comprises an air jet applied to the tow upstream of the additive applicator means and used to expand and centralise the tow. By passing the air from the separator to the banding jet any further additive remaining in the air should be captured by the tow.

It is possible to use the movement of the tow itself to extract air from a chamber by restricting the tow at its inlet to the chamber and allowing it to expand and pass out of the chamber in its expanded form. More air is then entrained with the tow on its exit than on its entrance to the chamber. The inlet for tow may be adapted by having converging guides and means adapted to direct air entrained with the tow away from the chamber. Thus the tow may be compressed on entry to the chamber against a permeable surface leading to a chamber vented to atmosphere. The converging guides could be supplied with a small amount of additive to lubricate the tow and reduce drag as it is compressed by the guides.

The different aspects of the invention may be embodied in apparatus for making a filter rod either individually or in combination.

Figure 2:
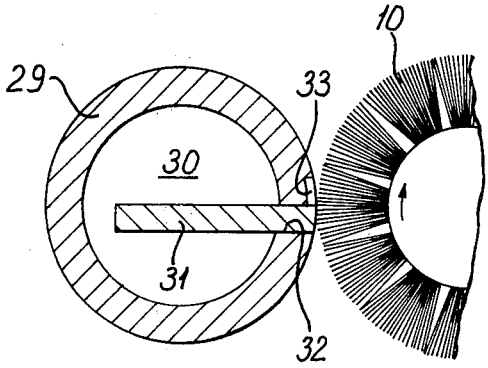

The invention will be further described, by way of example only, with reference to the accompanying diagrammatic drawings in which:

FIG. 1 shows apparatus for applying plasticiser to a tow of filter material, FIG. 2 shows a modification of part of the apparatus of FIG. 1, FIG. 3 shows a modification of another part of the apparatus of FIG. 1, and FIG. 4 shows a modification of still another part of the apparatus of FIG. 1.

The apparatus shown in FIG. 1 is associated with a filter rod making machine, such as a Molins PM5N, which forms filter tow into a continuous rod and cuts it into individual filter rod lengths. Means (not shown) are provided for continuously withdrawing a web of filter tow 1 from a supply and moving it through the apparatus, in the direction indicated by the arrows, at a speed generally dependent on the operating speed of the rod making machine.

The web of tow 1, which is typically 150–250 mm wide and 3–5 mm in depth, is arranged to pass through a plasticiser applicator chamber or booth 2 which includes an upper detachable portion 25 and a lower fixed portion 26. The width of the booth 2 just exceeds that of the tow, so that, typically, it is about 300 mm wide. The length of the booth 2 may be about 400 mm. Plasticiser is supplied to the booth 2 by withdrawal from a storage tank 4 using a constant displacement pump 5 driven by an infinitely variable gearbox 6 from an input shaft 7, the speed of which varies in accordance with the speed of the tow 1. The plasticiser is delivered by the pump 5 to a distributing manifold 8 which comprises an elongate chamber provided with apertures along the length of a concave surface closely adjacent to the periphery of a driven roll 9 having an impervious surface, e.g. of ground steel.

The manifold 8 applies plasticiser evenly along the length of the roll 9 and the latter is rotated at a speed which will permit a stable film of plasticiser to be picked up and conveyed. The speed of the roll 9 may be of the order of 100 rpm and the film thickness of the order of 0.1 mm. The speed of roll 9 may be constant or could be related to the speed of the tow 1.

The roll 9 serves to even the flow and distribution of plasticiser from the manifold 8 to a rotatable brush 10 which is in peripheral contact with the roll. The brush 10 is rotated at a relatively high speed (e.g. 2000 rpm) and its bristles pluck the plasticiser from the surface of the roll 9 and project it as fine droplets towards the passing tow 1. Baffles 11 and 12 restrict the arc of the spray of droplets by interception and plasticiser thus collected on the baffles is allowed to fall onto the roll 9 and/or brush 10, where it augments the plasticiser delivered directly from the manifold 8, or to the bottom of the booth 2, from where it is returned to the tank 4 through a drain conduit 27. A coarse seive 13 is provided beneath the roll 9 and brush 10 to remove tow fly (small fibrous particles of the tow which have been separated from the web) from plasticiser which is returned to the tank 4. The baffles 11 and 12 may be provided with grooves extending in a direction generally parallel to the movement of the tow to restrict transverse migration of plasticiser which could cause an undesirable variation in the distribution of plasticiser across the width of the web of tow 1.

Not all the plasticiser droplets sprayed by the brush 10 will be captured by the tow and some will pass into the upper portion 25 of the booth 2, usually having passed through the tow. A plate 15 is suspended just above the upper surface of the tow 1 opposite the region from which plasticiser is sprayed upwards. The plate 15 is porous and forms the lower surface of a chamber 14 to which air under pressure may be delivered. In use, air exhausting from the chamber 14 through the plate 15 has a high velocity near the surface of the plate and prevents droplets of plasticiser which are not captured during their upward passage through the tow 1 from coalescing and redirects the droplets downwards into the tow to improve capture and distribution of the plasticiser through the depth of the tow. The flow of air through the plate 15 may prevent small droplets reaching the plate, redirecting them towards the tow 1, whereas larger droplets, which may reach the plate, are rapidly dispersed by bubble forming and the resultant smaller droplets subsequently again projected towards the tow.

The material of which the plate 15 is made has a microporous structure wherein the size of the pores and the mean pitch of the pore matrix are small compared with the average diameter of the incident droplets. A suitable material is a permeable high density polyethylene such as one of the VYON range of materials manufactured by Porvair Limited of Kings Lynn, Norfolk. VYON DM, for example, having a thickness of 20 mm and mean pore size of 0.06 mm and allowing an air flow of about 5 cu.m/m$^2$/min. at 4000 Pa. (0.6 psi), could be used.

In order to provide the desired air flow through the plate 15 the pressure in the chamber 14 is maintained above that in the booth 2. Typically the pressure differential is of the order of 2000–6000 Pa. (0.3–1 psi). The pressure in the chamber 14 is maintained by an air supply from a compressor 22, the air passing through an ionising chamber 23 powered by an alternating high voltage source 24. The ionisation serves to aid neutralisation of electrostatic charges which may build up within the booth 2 and on the tow 1.

It is preferred to maintain the pressure in the booth 2 at or just below atmospheric pressure so that plasticiser loss in air leaking from the booth is reduced. Controlled extraction of air from the booth 2 is therefore provided by means of a pump 16 which draws air through a coarse screen 17, which captures tow fly. Pressure sensor means (not shown) may be provided in the booth 2 to control operation of the pump 16 (and possibly also the compressor 22). A baffle 18 is provided in the upper portion 25 of the booth 2 to restrict the flow of air directly from the plate 15 to the screen 17 so that, in general, air passes through the tow 1 before being extracted; this further improves capture of plasticiser by the tow. The extraction of air downstream of the spray position has the further advantage that droplets swept beyond the baffle 12 by the movement of the tow 1 and induced air eddies are captured by the tow as air is drawn from the booth by the pump 16.

The exit air from the pump 16 passes through a separator 19, which may for example comprise a series of baffles, for extracting any plasticiser still remaining in the air and returning it via a conduit 28 directly to the tank 4.

Upstream of the booth 2 is a conventional banding jet 20 supplied with air under pressure from a pump 21. The banding jet 20 serves to laterally extend and centralise the web of tow 1. The air exhausted from the separator 19 is mixed with the air supplying the banding jet 20. Unseparated droplets of plasticiser will be captured by the tow 1 as it passes through the banding jet 20.

Various modifications in the design of the apparatus are possible.

For example, more than one manifold may supply fluid to the roll 9 so that the film on the roll may be composed of a mixture of fluids from different sources. Thus an additional manifold could be supplied with plasticiser from the separator 19. Alternatively, or additionally, a manifold could be supplied with a different fluid which it is required to add to the tow 1.

Plasticiser (or other fluid) could be supplied directly to the brush 10 from one or more manifolds, the transfer roll 9 then normally being unnecessary. For example, FIG. 2 shows a modified arrangement for supplying plasticiser to the brush 10, in which the manifold 8 and roll 9 are replaced by a stationary hollow cylinder 29 of impervious material enclosing a space 30 into which plasticiser is introduced in an axial direction at a metered rate, e.g. by the pump 5. A strip 31 of porous material, such as VYON DM, extends longitudinally of the cylindrical space 30 and through a longitudinal slot 32 in the cylinder 29. The outer periphery of the strip 31 is shaped to correspond with the periphery of the cylinder 29 and adjacent the strip is an insert 33 of wear-resistant material. Plasticiser introduced into the space 30 is transferred by the porous material 31 to the outer surface of the cylinder 29 and is continuously removed by the rotating brush 10 and sprayed upwards towards the tow.

Instead of arranging for plasticiser to drain from the booth 2 to the tank 4 the brush 10 could be positioned close to the bottom of the booth 2, which could be shaped to closely follow its periphery so that the brush picks up any plasticiser which has drained to the bottom of the booth and sprays it upwards again.

The movement of the tow 1 through the booth 2 could be used to extract air from the booth, either to supplement another extraction system or as the sole extraction means. As shown diagrammatically in FIG. 3, the tow 1 could be pinched or restricted at a modified inlet 35 to the booth and allowed to expand in the booth and pass through the outlet in its expanded form. Thus the flow of air into the booth with the tow is less than that passing out of the booth with the tow. At the tow inlet 35 gradually converging guides 36, 37 may pinch the tow together. An upper porous guide 38 may be used to allow entrained air to flow through it and into a chamber 39 which is vented to atmosphere (rather than into the booth) at its ends. Alternatively the chamber 39 may be exhausted by a pump. The porous surface of the guide 38 could be a brush, comb or other mesh-like material, with elements running in such a direction that drag on the tow 1 is minimised. The upper surface of the tow 1 may be flattened slightly by contact with this surface and form a denser layer which helps to capture plasticiser and fly in the booth. Small quantities of plasticiser may be supplied to the inlet guides 36, 37, 38 for the tow 1, to lubricate the tow and to reduce drag on the tow as it is pinched, for example by allowing plasticiser to pass through the chamber 39 onto the porous guide 38.

Air may be extracted from the bottom portion 26 of the booth 2 instead of or as well as from the upper portion 25. Air extracted from the booth 2 could be passed through a separator and then to the chamber 14 rather than to the banding jet 20. A single pump could be used to provide air pressure to the chamber 14 and/or the banding jet 20 and to extract air from the booth 2. One or more regulators may be necessary to control pressures in the chamber 14 and booth 2. The extraction of air from the booth 2 could be by means of a venturi in the path of air supplied from a pump.

Plasticiser separated from the air extracted from the booth 2 could be returned directly to the booth 2, either by a conduit or by positioning a separator within the booth. Thus a centrifugal separator may be associated with the outlet for extracted air from the booth 2.

FIG. 4 shows a combined air extractor and centrifugal separator 40. This comprises a pipe 42 of relatively large bore leading from the applicator booth for extracting air from it. A pipe 44 of smaller bore is coaxially supported within the end region 45 of the pipe 42. The pipe 44 has a closed end 46 near which are a number of apertures 48 arranged around the pipe and which pass through the wall of the pipe in a direction which is inclined to the axial and radial axes of the pipe in such manner that air introduced into the pipe 44 from a pressure source passes through the apertures 48 with a downward and circumferential component of velocity relative to the pipe. Thus air passing into the end region 45 of pipe 42 through the apertures 48 is given a swirling downward generally helical movement, towards the exit 50 of the pipe. Typically air at a pressure of 15–20,000 Pa. (2½–3 psi) in the pipe 44 is sufficient to cause adequate extraction of air from the booth through the pipe 42. Thus air passing out through the exit 50 includes air introduced by the pipe 44 and also extracted air. The generally helical motion of this air in the end region 45 of the pipe 42 causes entrained plasticiser droplets to collect on the inner sides of the pipe. Helical internal channels 54 are provided to collect downwardly-draining plasticiser and pass it to a drain pipe 56. The channels 54 help to promote the desired air motion. Internal grooves could be used instead of the channels 54. Alternatively plasticiser could be collected by a container placed beneath the exit 50. Plasticiser so collected or plasticiser from the drain pipe 56 may be returned directly to the applicator booth. The FIG. 4 arrangement could replace the pump 16 and separator 19 of the FIG. 1 arrangement.

We claim:

1. Apparatus for treating filter material, including means defining a path for filter tow, a chamber through which said path passes, means for supplying fluid additive including means for directing additive towards the path for the tow in a first direction in said chamber, means for causing an air flow to direct additive towards the tow in a second direction in said chamber, said air flow means comprising an intercepting plate located closely adjacent to and extending substantially across the entire width of said tow path, said plate being air permeable and forming the boundary of an air pressure manifold, whereby said plate is arranged to intercept fluid additive which has penetrated the tow and to diffuse said air flow to disperse and propel said intercepted additive towards the tow.

2. Apparatus as claimed in claim 1, wherein the supplying means is arranged to direct additive towards the air flow means.

3. Apparatus as claimed in claim 2, wherein the supplying means includes means for spraying additive towards the tow.

4. Apparatus as claimed in claim 1, wherein the air flow means is arranged to direct additive which has passed through the tow.

5. Apparatus as claimed in claim 4, wherein the supply means and the air flow means are arranged on opposite sides of the tow path.

6. Apparatus as claimed in claim 1, wherein the air flow means is arranged to direct additive over a substantial area of the tow path.

7. Apparatus as claimed in claim 6, wherein the air flow means is arranged to direct additive over substantially the entire width of the tow path.

8. Apparatus as claimed in claim 1, including means for controlling air pressure in the chamber.

9. Apparatus as claimed in claim 8, wherein the controlling means is arranged to maintain air pressure in the chamber at slightly below ambient pressure.

10. Apparatus as claimed in claim 9, including means for extracting air from the chamber.

11. Apparatus as claimed in claim 10, wherein the air flow means and the extracting means are positioned such that air introduced by the air flow means crosses the tow path at least once before being extracted.

12. Apparatus as claimed in claim 10, including means for separating fluid additive from extracted air and returning it for reapplication to the tow.

13. Apparatus as claimed in claim 1, including means for removing air from the chamber with the tow.

14. Apparatus as claimed in claim 13, wherein the means for removing air with the tow includes means for confining the tow at an entrance to the chamber, so that less air is entrained with the tow on entrance to the chamber than on exit from the chamber.

15. Apparatus as claimed in claim 14, including means for extracting air from the tow before it enters the chamber.

16. Apparatus as claimed in claim 1, wherein the air flow means is arranged to re-direct additive from said directing means.

17. Apparatus as claimed in claim 16, wherein the air flow means includes a permeable element through which air may flow to re-direct additive.

18. Apparatus as claimed in claim 17, wherein the permeable element is located adjacent said tow path substantially opposite said delivering means.

19. Apparatus for treating filter material, including means defining a path for filter tow, a chamber through which said path passes, means for supplying fluid additive including means for directing additive towards the tow in a first direction in said chamber, means for causing an air flow to direct additive towards the tow in a second direction in said chamber, and means for ionising air supplied to said air flow means.

20. Apparatus for treating filter material, comprising an applicator chamber through which filter tow may be passed, applicator means by which fluid additive is supplied to the tow in said chamber, means for extracting air from the chamber, and means for separating fluid additive from extracted air, and means for applying separated fluid additive to the tow at a position outside said chamber.

21. Apparatus as claimed in claim 20, wherein the separated additive is supplied to a banding jet upstream of said applicator chamber and by which the tow is spread and positioned before entering the chamber.

22. Apparatus for treating filter material comprising an applicator chamber through which filter tow may be passed between an entrance and an exit of the chamber, said entrance being smaller than said exit, applicator means by which fluid additive is supplied to the tow in said chamber, and means for extracting air from the chamber, wherein the extracting means includes means for confining the tow at the entrance of said chamber to a greater extent than at the exit of said chamber so that said entrance is smaller than said exit, thereby causing said tow to be compressed at said entrance, allowing said tow to expand within said chamber and causing air to be entrained with the tow within the chamber, thereby extracting air from the chamber with the tow passing from the chamber via said exit.

23. Apparatus as claimed in claim 22, including means for extracting air from the tow adjacent the entrance to the chamber.

24. Apparatus as claimed in claim 23, including converging guides at the entrance to the chamber and at least one permeable surface through which air passes from the tow.

25. Apparatus as claimed in claim 24, including means for supplying small quantities of fluid additive to said converging guides to lubricate the passing tow.

26. Apparatus for treating filter material, including an applicator chamber, means for moving filter tow through the chamber, primary applicator means for directing fluid additive towards the tow in said chamber so that a proportion of said additive is captured by the tow and becomes impregnated therein, and second applicator means for re-directing towards the tow additive directed by the primary applicator means and not initially captured by the tow, the secondary applicator means including means for causing an air flow towards the tow in said chamber, said secondary applicator means including a plate having a microporous structure and an air pressure chamber in communication with said plate on the side thereof opposite said tow for supplying air through said plate toward said tow.

27. Apparatus for treating filter material, comprising means defining a path for filter tow, a chamber through which said path passes, means for supplying fluid additive including first means positioned on one side of said tow in said chamber for directing additive towards the tow, and second means positioned on the opposite side of said tow from said first means for causing an air flow to re-direct the additive from said first means which has passed through said tow back towards said tow, said second means including a plate having a microporous structure and an air pressure chamber in communication with said plate on the side thereof opposite said tow for supplying air through said plate toward said tow.

* * * * *